US006322170B1

(12) United States Patent
Knell et al.

(10) Patent No.: US 6,322,170 B1
(45) Date of Patent: Nov. 27, 2001

(54) APPARATUS AND METHOD OF PREVENTING REFUSE FROM WRAPPING AROUND THE AXLE OF A WORK MACHINE

(75) Inventors: Harvey A. Knell; Eric R. O'Brien, both of Yorkville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/526,711

(22) Filed: Mar. 15, 2000

Related U.S. Application Data

(60) Provisional application No. 60/137,124, filed on May 28, 1999.

(51) Int. Cl.[7] ..... B62D 55/088

(52) U.S. Cl. ..... 305/107; 305/100; 404/129

(58) Field of Search ..... 305/100, 107, 305/109, 110; 172/514, 540; 404/121, 122, 124, 128, 129; 280/855, 856

(56) References Cited

U.S. PATENT DOCUMENTS

| | | | | |
|---|---|---|---|---|
| 1,812,543 | * | 6/1931 | White | 305/100 |
| 1,992,702 | * | 2/1935 | Koop . | |
| 2,146,882 | * | 2/1939 | Baker et al. | 305/107 |
| 2,425,219 | * | 8/1947 | Armington | 305/107 |
| 3,633,471 | | 1/1972 | Randour . | |
| 3,861,762 | * | 1/1975 | Freedy et al. | 305/100 |
| 3,912,336 | * | 10/1975 | Ritter et al. | 305/107 |
| 3,913,985 | * | 10/1975 | Orr et al. | 305/100 |
| 3,988,071 | | 10/1976 | Cochran et al. . | |
| 4,818,040 | * | 4/1989 | Mezzancalla et al. | 305/107 |
| 5,676,493 | | 10/1997 | Brockway . | |
| 5,733,020 | * | 3/1998 | McCartney | 305/107 |
| 5,951,123 | * | 9/1999 | Bomstad et al. | 305/107 |
| 5,967,242 | * | 10/1999 | Caron et al. | 172/817 |
| 5,967,630 | * | 10/1999 | Sewell | 305/110 |
| 6,045,295 | * | 4/2000 | Puchosic | 404/128 |
| 6,123,399 | * | 9/2000 | Snyder | 305/107 |

OTHER PUBLICATIONS

Hanomag—"How to solve waste disposal problems", Hanover, Germany No Date.
Maximal: Die Sicherheit, p. 7 No Date.

* cited by examiner

*Primary Examiner*—Russell D. Stormer
(74) *Attorney, Agent, or Firm*—Byron G. Buck; Liza J. Meyers

(57) ABSTRACT

An apparatus and method of preventing refuse from wrapping around the axle of a work machine is disclosed. A work machine includes a frame, an axle, at least one wheel, an operator compartment, an engine, and an axle protection system. The at least one wheel has a rim extension having an outer portion. The axle protection system includes a roof guard and an axle guard assembly. The axle guard assembly has a plate and a labyrinth guard. A channel is provided by the configuration of the guard assembly, plate, and labyrinth guard such that the outer portion of the rim extension is received by the channel. The plate extends substantially vertically from the perimeter of the axle guard assembly. Preferably, a flexible member is attached to the edge of the plate and extends such that it is urged in contact with the roof guard.

19 Claims, 7 Drawing Sheets

APPARATUS AND METHOD OF PREVENTING REFUSE FROM WRAPPING AROUND THE AXLE OF A WORK MACHINE

This application claims the benefit of prior provisional patent application Ser. No. 60/137,124 filed May 28, 1999.

TECHNICAL FIELD

This invention relates generally to an apparatus and method of preventing refuse from wrapping around the axle of a work machine and, more particularly, to an apparatus and method that utilizes a roof guard.

BACKGROUND ART

Work machines such as motor graders, excavators, mining shovels, backhoe loaders, wheel loaders, track type tractors, wheeled tractors, track type loaders, compactors, and the like are used for operating on dirt and other materials. Typically, work machines may be configured to perform various work cycles. For example, the compactor typically has specialized compactor wheels used to compact waste materials or refuse.

In the operation of modern day landfills, it is imperative to obtain maximum compaction of the material deposited in the landfills to utilize their available capacity to its fullest extent. To that end, a relatively specialized machine has been developed to break up and compress the refuse and is commonly known as a landfill compactor. A typical compactor has specialized wheels that have a plurality of individual teeth that extend radially from a cylindrical drum. The teeth are separated from one another to localize the pressure, exerted by the weight of the machine, on the ends of the respective teeth. In doing so, more pressure is applied to the material under foot to thereby increase the amount of compactive force applied by the machine.

One problem associated with landfill compactors is the tendency for the wheel assembly to catch material on the teeth and entrain it about the adjacent axle assembly as the machine traverses the landfill. Wire, which is very often disposed of in landfills, is a particular problem. Typically, the inner row of teeth will snag the wire and carry it around the axle. As the movement of the machine continues, the wire will at some point in time become entrained about the axle, trapping all kinds of other debris which will eventually become packed into all the areas in and around the frame and the axle of the machine. Not only does this packing of material interfere with the proper operation of the machine, in some cases preventing proper axle oscillation, it also can create wear to the structure of the wheel assemblies and seals. The primary means of alleviating this situation is by removing the machine to a maintenance work area, removing the wheel assemblies, cutting the wire and debris away with a torch and manually removing the debris from the axle and frame. This is not only a costly, labor intensive exercise, but the machine is taken out of operation while this maintenance is performed. Ultimately, this can greatly increase the cost and inefficiency of the overall landfill operation.

In order to alleviate this problem, several different cutting devices have been added to the axle and/or wheel assembly to cut the debris as the wheel rotates. While this has been known to work in some applications, the additional components increase the overall cost of the machine. Also, the efficiency of the cutting mechanism is highly variable, requiring some periodic, debris-removal maintenance anyway. Further, the cutting mechanism eventually becomes worn or broken and the machine must be taken out of production while maintenance to the cutting mechanism is performed.

Positioning of the teeth over the cylindrical drum in a manner to reduce the tendency of refuse from falling from the wheel toward the frame and axle is known from U.S. Pat. No. 5,687,799 to Greenfield, et al. that issued on Nov. 18, 1997.

Further, it is known from U.S. Pat. No. 5,733,020 issued on Mar. 31, 1998, to McCartney, et al. to use a guard member for inhibiting wire, cable, and the like from entangling the axle assembly of a machine wheel. McCartney teaches the use of a guard member secured to the vehicle axle assembly between the wheel and the body of the vehicle. McCartney also teaches that the guard member should have a radially outer portion defining an arcuate surface which lies adjacent the rim of the wheel and follows the curvature of the wheel. McCartney suggests that this structure will prevent wire, cable, and the like from passing between the guard member and the wheel. McCartney specifically teaches an apparatus for directing refuse to fall between the guard member and the body of the vehicle.

Accordingly, the art has sought an apparatus and method of preventing refuse from wrapping around the axle of the work machine which: deflects refuse from falling onto the axle or between the guard assembly and the frame; reduces wear and damage to structural members; eliminates the need for cutting devices; reduces the need to take the machine out of operation for the purpose of maintaining the axle protection system; and is more economical to manufacture and use.

The present invention is directed to overcoming one or more of the problems as set forth above.

DISCLOSURE OF THE INVENTION

In one aspect of the present invention, a work machine adapted to be controlled by an operator upon a grade is provided. The work machine includes a frame, an axle, at least one ground engaging device, an operator compartment, an engine, and an axle protection system. The axle has an end portion having an end and the axle is pivotally connected to the frame. The at least one ground engaging device has an extension that is connected to the end of the axle. Further, the extension has an outer portion. The operator compartment is supported by the frame. The engine is operably coupled to the at least one ground engaging device. The axle protection system includes an axle guard assembly and a roof guard. The axle guard assembly has an outer perimeter, a plate, and a labyrinth guard. The axle guard assembly is attached to the end portion. The plate extends substantially vertically from the perimeter of the axle guard assembly. The labyrinth guard projects generally orthogonally along the plate and is spaced apart from the perimeter. This provides a channel adapted to receive the outer portion. A roof guard is fixed to the frame such that refuse is substantially deflected from falling onto the axle and axle guard assembly.

In another aspect of the invention, a method of preventing refuse from wrapping around the axle of the work machine is provided. Refuse is deflected from falling onto the axle or axle guard assembly. A rotating rim extension is passed through a stationary channel, thereby preventing refuse from wrapping around the axle.

In another aspect of the invention, an axle protection system for a work machine adapted to be controlled by an operator upon a grade is provided. The axle protection system includes an extension, an axle guard assembly, and a roof guard. The extension has an outer portion that is adapted to connect to a ground engaging device. The ground engaging device is adapted to connect to the axle. The roof guard is adapted to be fixed to the frame above the axle guard assembly such that refuse is substantially deflected from falling onto the axle and the axle guard assembly. The axle guard assembly has a plate, a labyrinth guard, and an outer perimeter and is adapted to attach to the axle. The plate extends substantially vertically from the perimeter. The labyrinth guard projects generally orthogonally along the plate and is spaced apart from the perimeter such that a channel is provided by the configuration of the guard assembly, plate, and labyrinth guard. The outer portion is adapted to be received by the channel.

BRIEF DESCRIPTION OF THE DRAWINGS

For a better understanding of the invention, reference may be made to the accompanying drawings in which.

BEST MODE FOR CARRYING OUT THE INVENTION

Figure 1:
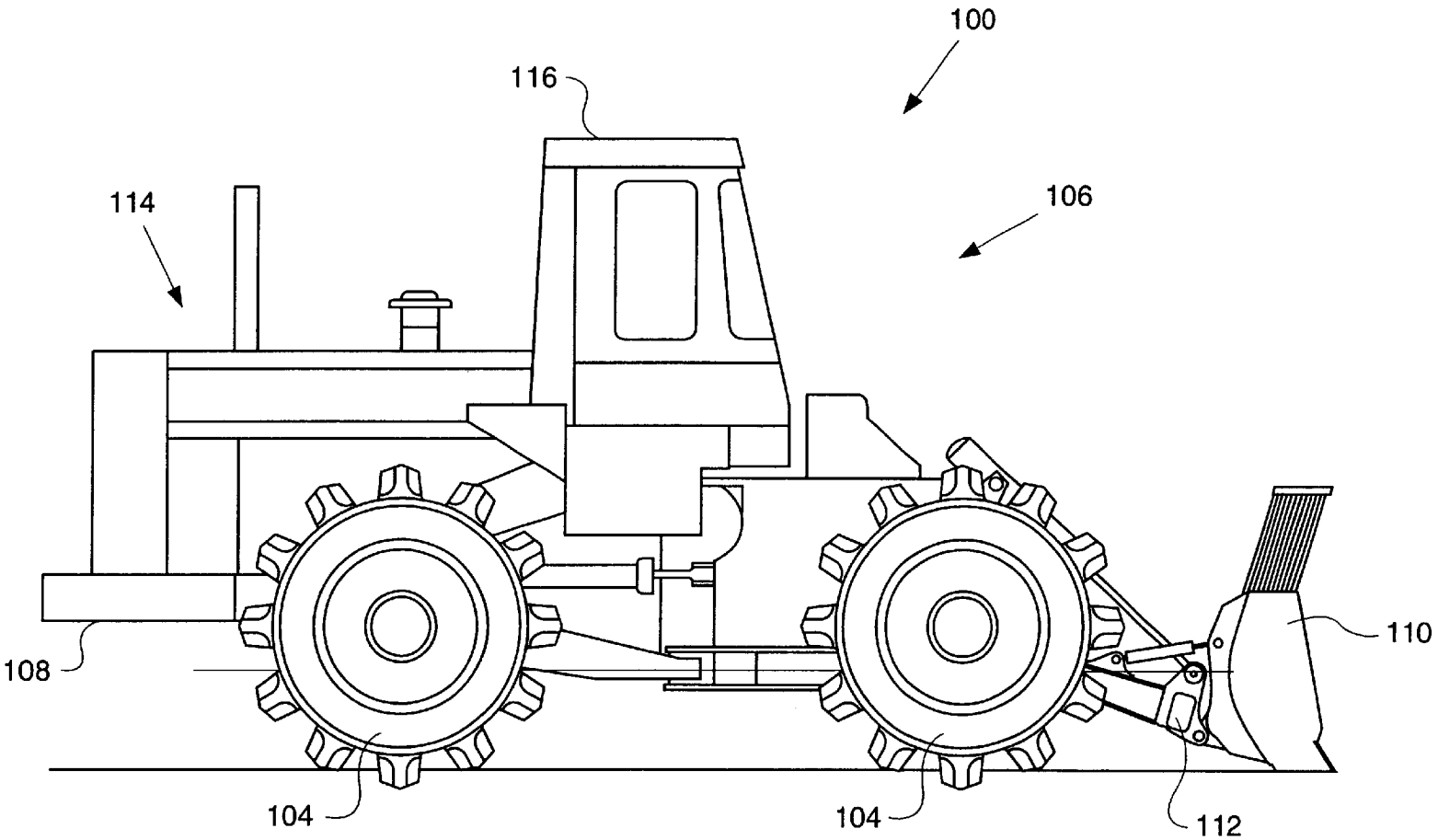
FIG. 1 is a side prospective view of a compactor according to an embodiment of the present invention.

A preferred embodiment of the present invention provides an apparatus and method of preventing refuse from wrapping around the axle 200 of the work machine 100 and damaging the axle 200, ground engaging devices, preferably wheels 104, or seals (not shown). The work machine 100 is adapted to be controlled by an operator through a plurality of work cycles. The following description uses a compactor 106 as an example only. This invention can be applied to other types of work machines 100 having tracks (not shown) instead of wheels 104. Examples of other work machines 100 include mining shovels, track type loaders, track type tractors, wheeled tractors, and the like.

In FIG. 1, a frame 108 is supported by a plurality of ground engaging devices or preferably wheels 104. A work implement 110, has a linkage 112 for operably connecting the implement 110 to the frame 108. Further, an engine 114 is operably coupled to the wheels 104. Additionally, an operator compartment 116 is supported by the wheels 104.

Figure 2:
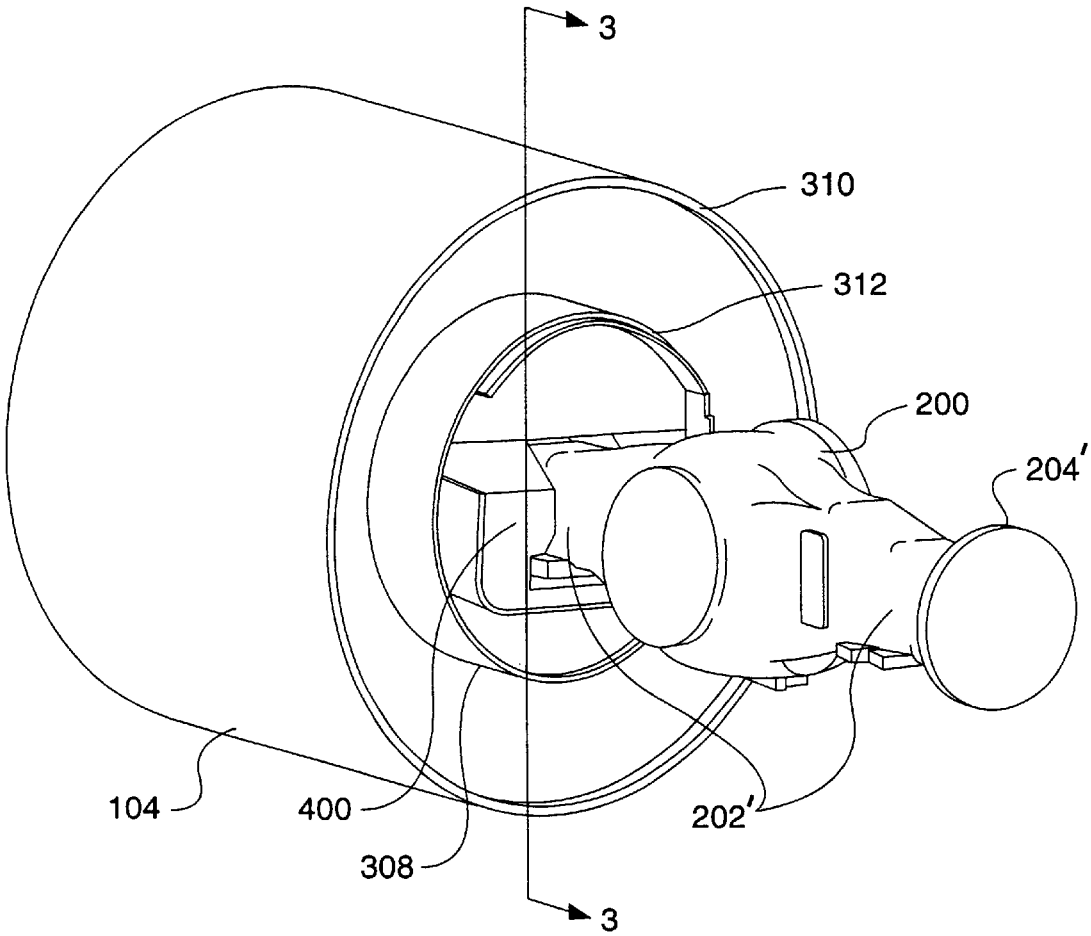
FIG. 2 is a side prospective view of the axle and interior side of the wheel, including the rim extension, according to an embodiment of the present invention.
Figure 4:
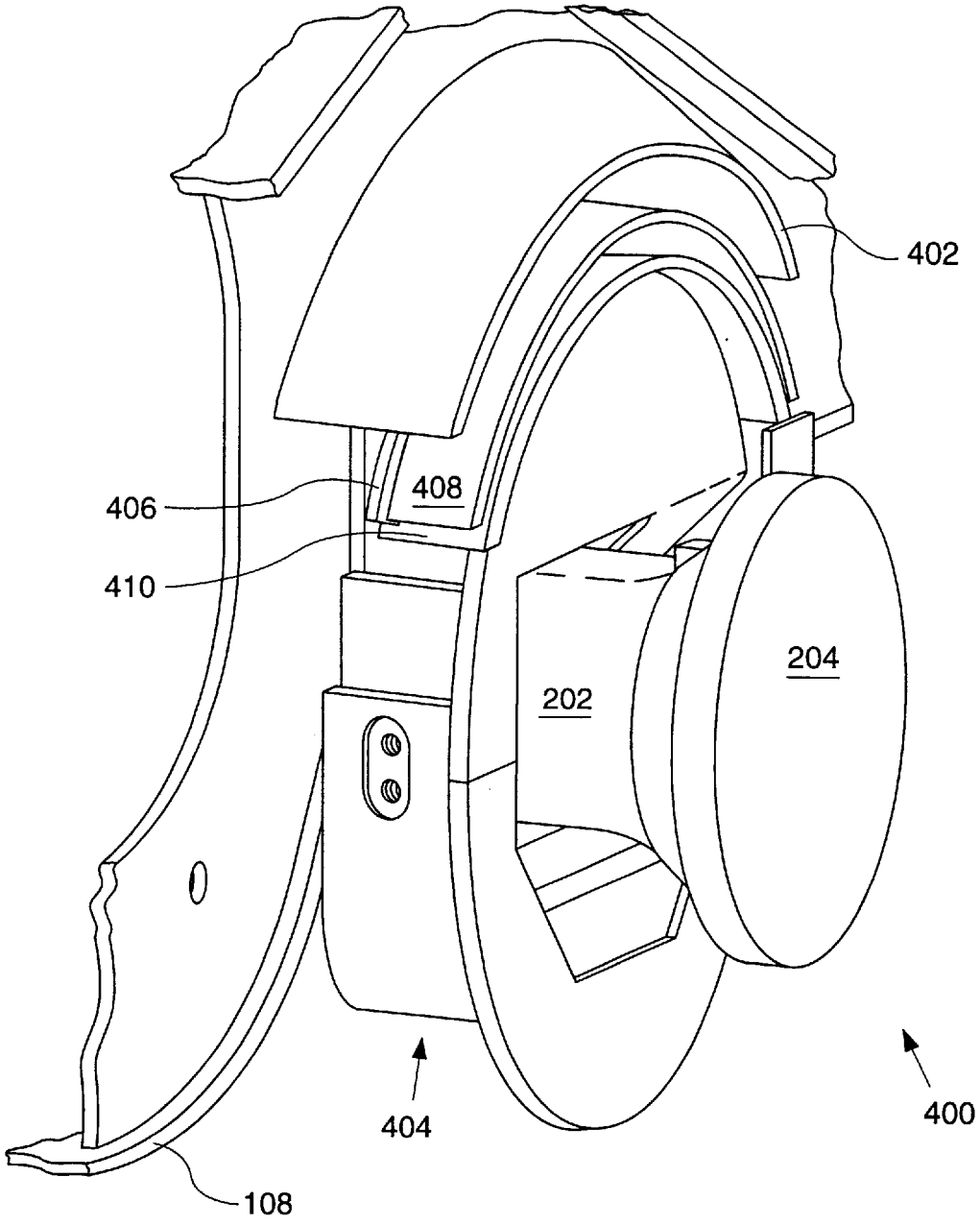
FIG. 4 is a prospective view showing an axle, roof guard, frame, and axle guard assembly according to an embodiment of the present invention.

Referring now to FIG. 2, the work machine 100 includes an axle 200 and an axle protection system 400 (FIG. 4). Primed reference numerals are used to denote elements having substantially the same structure as elements denoted with unprimed reference numerals. The axle 200 has an end portion 202, 202' having an end 204, 204'. The axle 200 is pivotally connected to the frame 108.

Preferably, the ground engaging devices are wheels 104. The wheels 104 have a central axis 300 a centroid 302, a central plane 304, an outer plane 306, an outer periphery 310, and a rim extension 308. The central plane 304 is perpendicular to the central axis 300 at the centroid 302. The periphery 310 is bounded by the outer plane 306. The outer plane 306 is perpendicular to the central axis 300. The rim extension 308 has an outer portion 312. The rim extension 308 projects concentrically about the central axis 300 to a position between the central plane 304 and the outer plane 306. Advantageously, the outer portion 312 projects to a position including the outer plane 306. The wheels 104 are connected to the end 204, 204' (FIG. 2) and are rotatable about the central axis 300.

Figure 3:
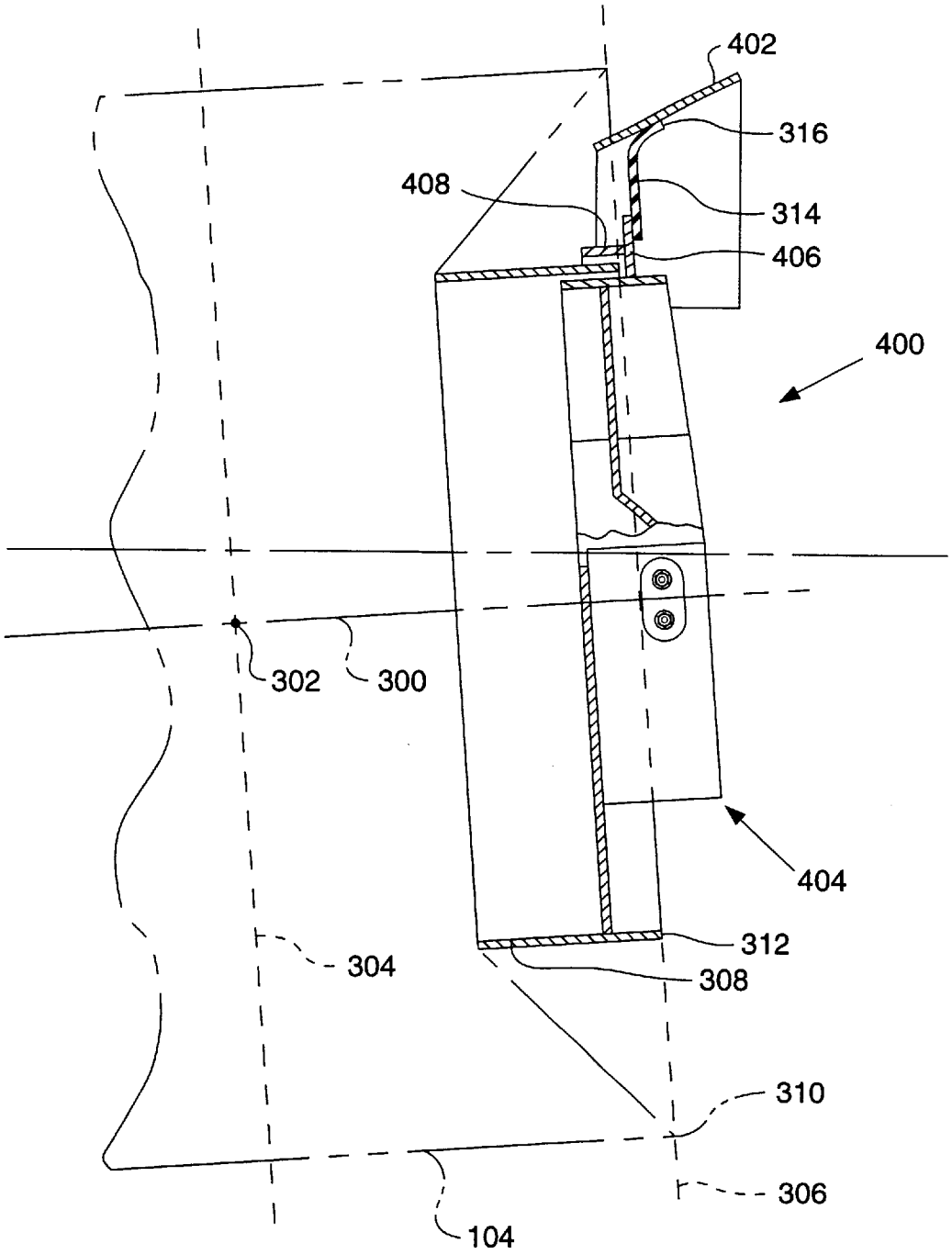
FIG. 3 is a partial cross-sectional view of the axle protection system taken along line 3—3 of FIG. 2.

Referring now to FIG. 4, the axle protection system 400 includes a roof guard 402, an axle guard assembly 404, and preferably a flexible member 314 (FIG. 3). In an embodiment, the axle protection system 400 includes an extension. Advantageously, the extension is similar to the rim extension 308 and is adapted to connect to a ground engaging device.

The roof guard 402 has a sloping curved geometry and is fixed to the frame 108 opposite the axle 200 from the grade. This is generally above the axle 200 and the axle guard assembly 404. The sloping curved geometry of the roof guard 402 is such that refuse is substantially deflected from falling onto the axle 200 and axle guard assembly 404. Preferably, the roof guard 402 slopes from the frame 108 at an angle in the range of about 30 to 75 degrees and is preferably 50 degrees as represented by $\theta$ in FIG. 5.

The axle guard assembly 404 has a plate 406 and a labyrinth guard 408. The axle guard assembly 404 has a generally annular geometry that defines an aperture and an outer perimeter 410. The axle guard assembly 404 is attached to the end portion 202 in such a manner that the end portion 202 is substantially central to the aperture.

Figure 5:
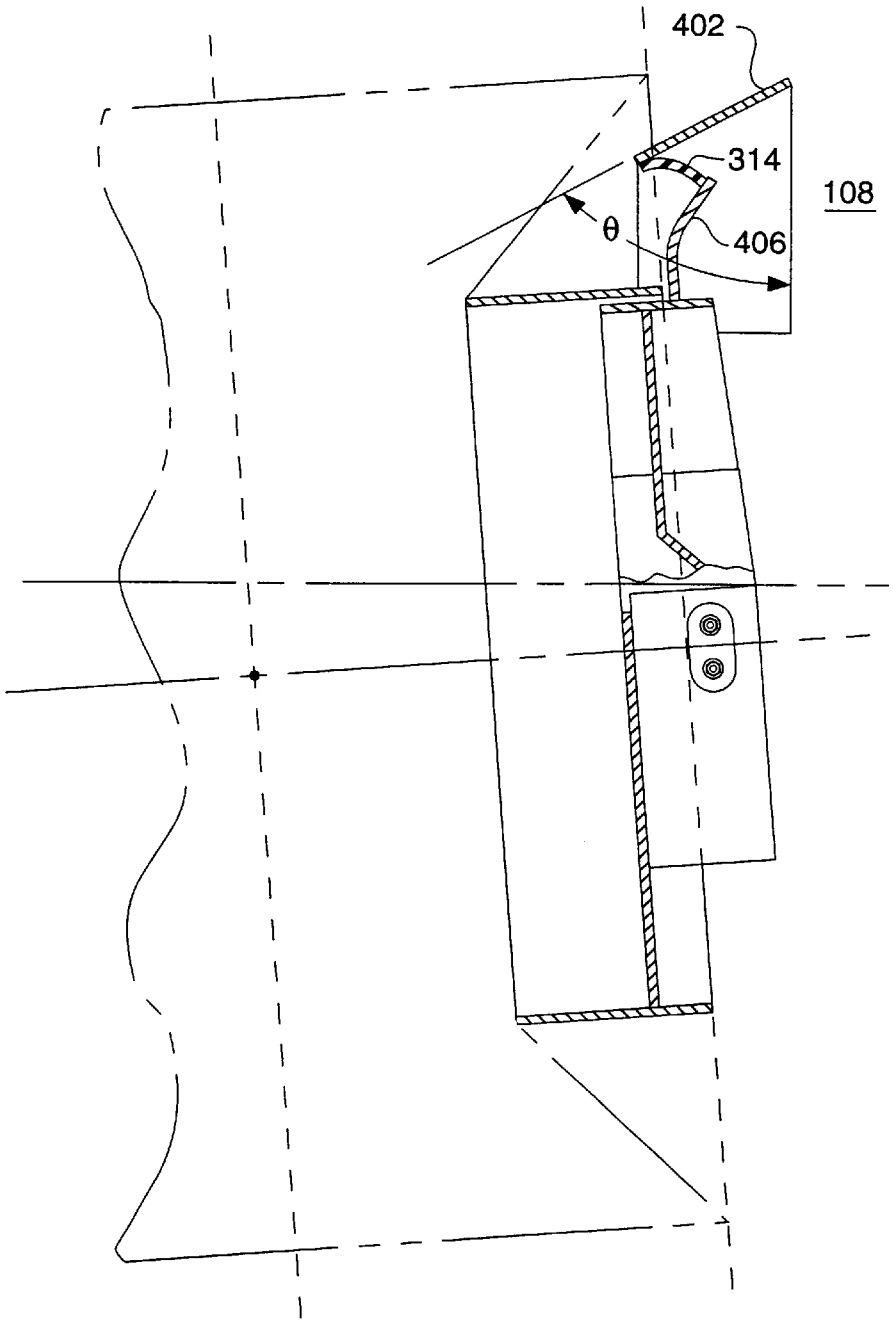
FIG. 5 is a partial cross-sectional view of the axle protection system according to an embodiment of the present invention.
Figure 7:
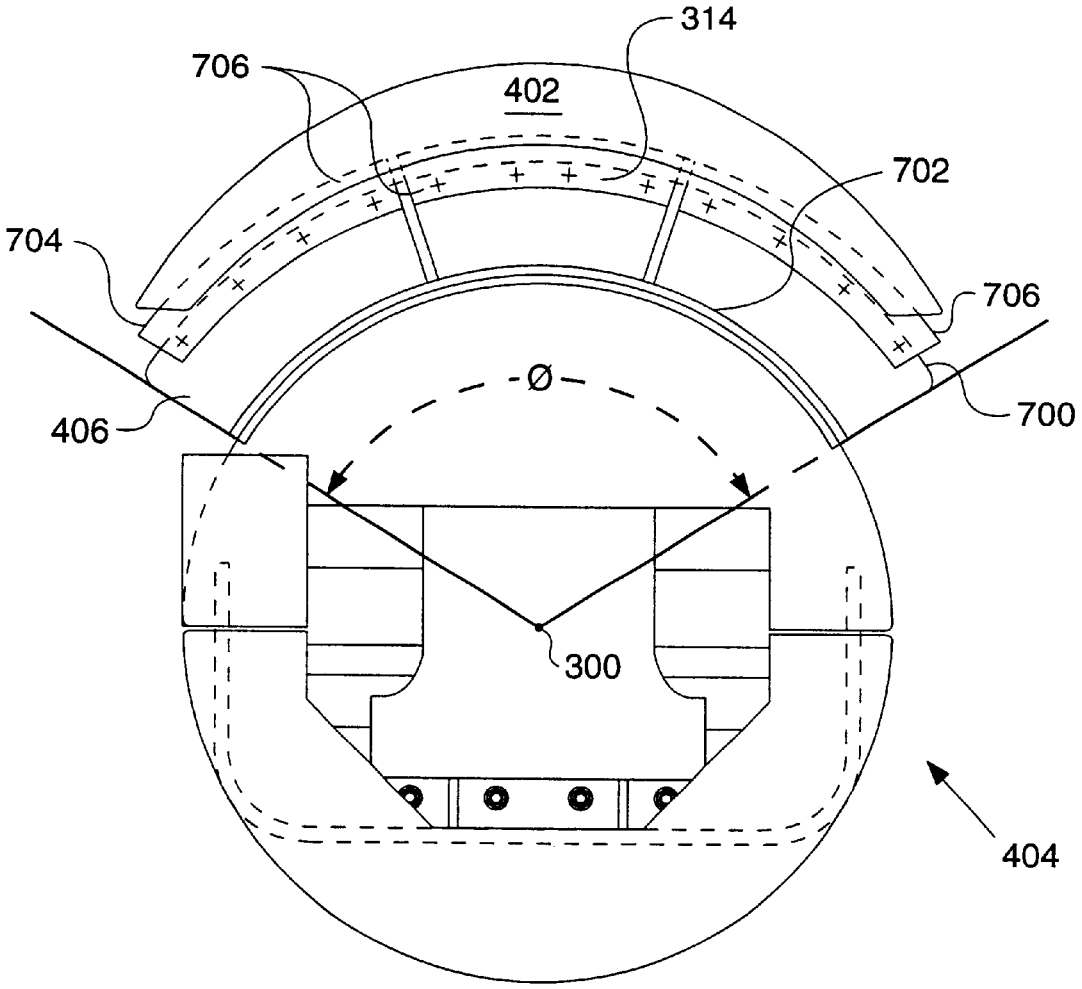
FIG. 7 is a side view of the axle protection system according to an embodiment of the present invention.

Referring now to FIG. 7, the plate 406 preferably has an outer edge 700 and extends substantially vertically from the perimeter 410 along a segment 702 of the perimeter 410. Advantageously, the segment 702 is substantially between the axle 200 and the roof guard 402. Additionally, it is advantageous for the segment 702 to extend in an arc of approximately 120 degrees determined radially from a point along the central axis 300 as indicated by the angle $\phi$ in FIG. 7. Notably, it is also preferable for the roof guard 402 to curve in an arc of approximately the same number of degrees as the segment 702 as determined from a point along the central axis 300. However, it should be appreciated that many different values for the number of degrees in the curve of the arc could be used without deviating from the scope of the present invention as defined by the appended claims. Referring now to FIG. 5, in an embodiment, the plate 406 extends beyond the connection of the labyrinth guard 408 with an arcuate geometry.

The labyrinth guard 408 projects generally orthogonally along the plate 406 and is spaced apart from the perimeter 410 such that a channel is provided by the configuration of the guard assembly 404, plate 406, and the labyrinth guard 408. The channel is such that the outer portion 312 of the rim extension 308 is received by the channel. Preferably, the outer portion 312 extends approximately two and one half inches within the channel (FIG. 3).

Referring back to FIG. 7, it is preferable that a flexible member 314 be attached to the edge 700 and extend such that it is urged in contact with the roof guard 402. Advantageously, the flexible member 314 is a cord reinforced rubber flap. In an embodiment, the flexible member 314 has a boundary 704 and a metal tip 316 running along the boundary 704 such that the metal tip 316 is urged in contact with the roof guard 402. Preferably, the cord reinforced rubber flap 314 includes a plurality of pieces 706, thereby providing for a better fit between the plate 406 and roof guard 402.

While aspects of the present invention have been particularly shown and described with reference to the preferred embodiment above, it will be understood by those skilled in the art that various additional embodiments may be contemplated without departing from the spirit and scope of the present invention. For example, other radial measurements and geometries could be used to determine the configuration of the roof guard. However, a device or method for incorporating such an embodiment should be understood to fall within the scope of the present invention as determined based upon the claims below and any equivalents thereof.

Industrial Applicability

Heavy machinery, heavy equipment, work machines 100, and other machinery like compactors 106 are often used to traverse a grade. To accomplish this, it is important that refuse does not attempt to work between the wheels 104 and the frame 108 around the axle 200. If this condition is allowed to occur and the refuse is not removed, damage can result to the axle 200, wheels 104, and seals (not shown).

Figure 6:
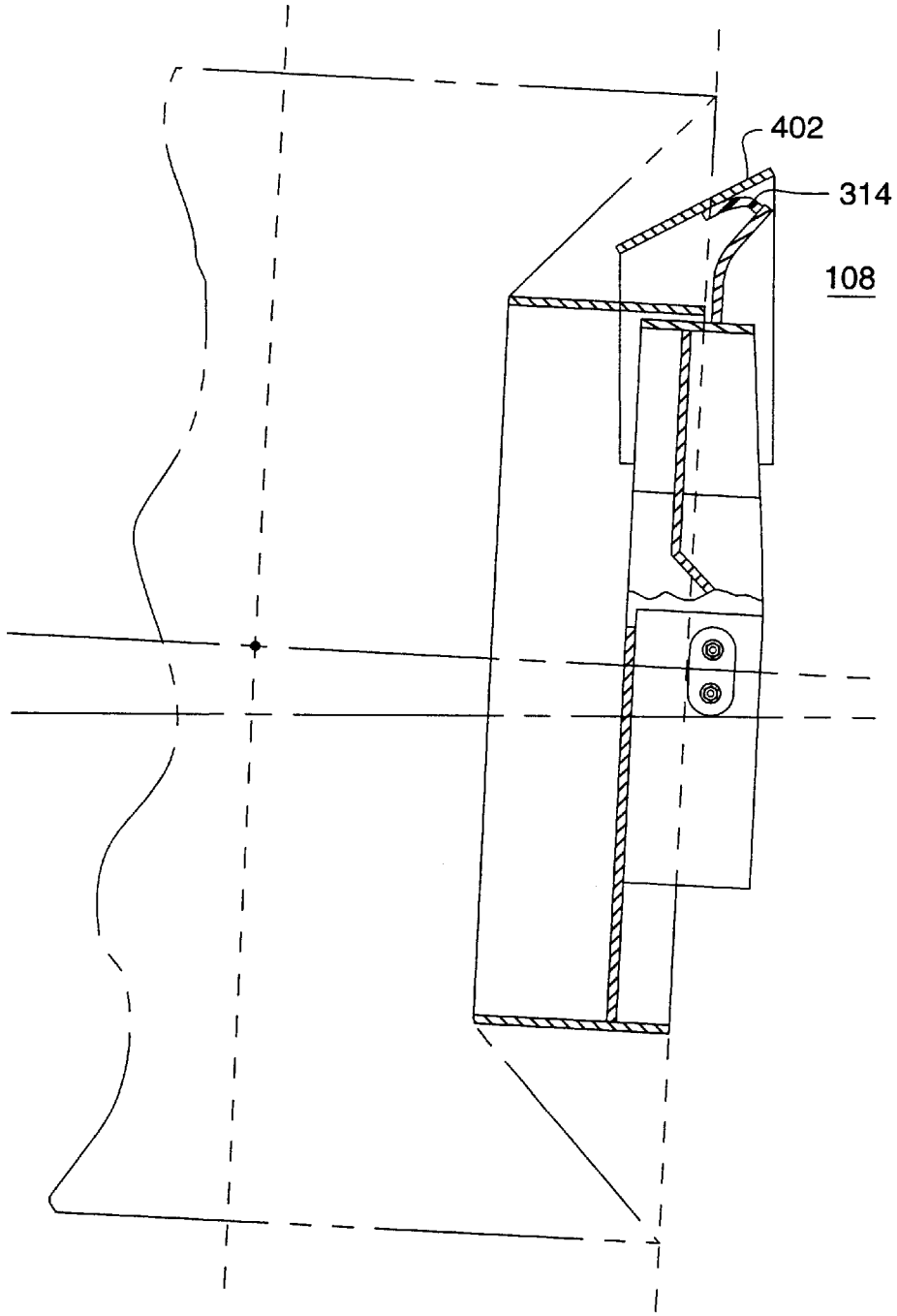
FIG. 6 is a partial cross-sectional view of the axle protection system according to an embodiment of the present invention.

This condition is exacerbated by the vertical oscillation of the axle as the work machine 100 travels across an uneven grade. Typically, the travel of the axle 200 is about the horizontal of plus or minus six to seven degrees. FIG. 3 and FIG. 5 illustrate different embodiments shown with the axle deflected below the horizontal. FIG. 6 illustrates an embodiment with the axle 200 deflected above the horizontal. From a comparison of FIGS. 3, 5, and 6, the increased separation between outer edge 700 and the roof guard 402 when the axle 200 is in the below horizontal position as opposed to the above horizontal position is apparent. Through the use of the roof guard 402, this separation is protected and refuse is deflected away from the axle 200 and the axle guard assembly 404. This serves to keep refuse from working between the wheels 104 and frame 108 and around axle 200.

Further, the effect of the plate 406 extending with an arcuate geometry allows for alternative orientations of the flexible member 314. Therefore, the affect of the roof guard 402 deflecting refuse from falling onto the axle or axle guard assembly becomes extremely useful. Further, a combination of the roof guard 402 and the flexible member 314 attached to the edge 700 provides enhanced protection in preventing refuse from wrapping around the axle 200 and falling onto the axle 200 or axle guard assembly 404. The flexible member 314 prevents refuse not deflected by the roof guard 402 from working between the edge 700 and the roof guard 402 and onto axle 200 or between the frame 108 and axle guard assembly 404.

The apparatus and method of certain embodiments of the present invention, when compared with other methods and apparatus, may have the advantages of: deflecting refuse from falling onto the axle or between the guard assembly and the frame; reducing wear and damage to structural members; eliminating the need for cutting devices; reducing the need to take the machine out of operation for the purpose of maintaining the axle protection system; and being more economical to manufacture and use. In addition, the present invention may provide other advantageous that have not been discovered yet.

It should be understood that while the preferred embodiment is described in connection with a compactor 106, the present invention is readily adaptable to provide similar functions on other work machines 100. Other aspects, objects, and advantages of the present invention can be obtained from a study of the drawings, the disclosure, and the appended claims.

What is claimed is:

1. A work machine controlled by an operator upon a grade, comprising:

a frame;

an axle having an end portion having an end, the axle being pivotally connected to the frame;

at least one ground engaging device having an outer plane, a recessed portion, and an extension having an outer portion and spaced from the outer plane and extending from an inmost part of the recessed portion, the at least one ground engaging device being connected to the end;

an operator compartment supported by the frame;

an engine operably coupled to the at least one ground engaging device; and an axle protection system, including:

an axle guard assembly having a plate and a labyrinth guard, the axle guard assembly having an outer perimeter and being adjacent to the end portion;

a roof guard fixed to the frame such that refuse is substantially deflected from falling onto the axle and axle guard assembly;

the plate extending substantially vertically from the outer perimeter; and the labyrinth guard projecting generally orthogonally along the plate and spaced apart from the perimeter such that a channel is provided by the configuration of the guard assembly, plate and labyrinth guard and the outer portion is adapted to be received by the channel.

2. The work machine of claim 1, wherein the at least one ground engaging device has a central axis and the roof guard and plate extend in an arc of approximately 120 degrees determined radially from a point along the central axis.

3. The work machine of claim 1, wherein the outer portion extends approximately 2.5 inches within the channel.

4. The work machine of claim 1, wherein the at least one ground engaging device is at least one wheel having a centroid, a central axis, a central plane perpendicular to the central axis at the centroid, and an outer periphery bounded by an outer plane perpendicular to the central axis and wherein the extension is a rim extension that projects to a position between the central plane and the outer plane, including the outer plane.

5. The work machine of claim 1, wherein the plate extends beyond the connection of the labyrinth guard and extends with an arcuate geometry.

6. The work machine of claim 1, wherein the plate has an outer edge and wherein a flexible member is attached to the edge and extends to contact the roof guard.

7. The work machine of claim 1, wherein the roof guard slopes from the frame at an angle in the range of about 30 to 75 degrees.

8. A work machine controlled by an operator upon a grade, comprising:

a frame;

an axle having an portion having an end, the axle being pivotally connected to the frame;

at least one ground engaging device having a central axis, a centroid, a central plane perpendicular to the central axis at the centroid, and an outer periphery bounded by an outer plane perpendicular to the central axis and a rim extension having an outer portion and projecting concentrically about the central axis to a position between the central plane and the outer plane, including the outer plane, the ground engaging devices being connected to the end and rotatable about the central axis;

an operator compartment supported by the frame;

an engine operably coupled to the at least one wheel; and an axle protection system, including:

an axle guard assembly having a plate and a labyrinth guard, the axle guard assembly having a generally annular geometry defining an aperture therethrough and an outer perimeter and substantially surrounding the end portion in such a manner that the end portion is substantially central to the aperture;

a roof guard having a sloping curved geometry and being fixed to the frame generally opposite the axle from the grade such that refuse is substantially deflected from falling onto the axle and axle guard assembly, the roof guard sloping from the frame at an angle in the range of about 30 to 75 degrees;

the plate having an outer edge and the plate extending substantially vertically from the outer perimeter along a segment of the perimeter, the segment being substantially between the axle and the roof guard and extending in an arc of approximately 120 degrees determined radially from a point along the central axis;

a cord reinforced rubber flap having a boundary and a metal tip along the boundary and being attached to the edge and extending such that the metal tip is urged in contact with the roof guard; and the labyrinth guard projecting generally orthogonally along the plate and spaced apart from the outer perimeter such that a channel is provided by the configuration of the guard assembly, plate and labyrinth guard and the outer portion of the rim extension is adapted to be received by the channel such that the outer portion extends approximately 2.5 inches within the channel.

9. The work machine of claim 8, wherein the plate extends beyond the connection of the labyrinth guard and extends with an arcuate geometry.

10. An axle protection system for a work machine adapted to be controlled by an operator upon a grade and having a frame supported by an axle, comprising:

an extension having an outer portion and adapted to connect to a ground engaging device, the ground engaging device being adapted to connect to the axle and having a central axis and an outer plane spaced therefrom, the extension located nearer the central axis than the outer plane;

an axle guard assembly having a plate, a labyrinth guard and an outer perimeter and being adapted to attach to the axle;

the plate extending substantially vertically from the perimeter;

the labyrinth guard projecting generally orthogonally along the plate and spaced apart from the perimeter such that a channel is provided by the configuration of the guard assembly, plate and labyrinth guard and the outer portion is adapted to be received by the channel; and a roof guard adapted to be fixed to the frame above the axle guard assembly such that refuse is substantially deflected from falling onto the axle and axle guard assembly.

11. The work machine of claim 10, wherein the ground engaging device has a central axis and the roof guard and plate extend in an arc of approximately 120 degrees determined radially from a point along the central axis.

12. The work machine of claim 10, wherein the outer portion extends approximately 2.5 inches within the channel.

13. The work machine of claim 10, wherein the ground engaging device is a wheel having a centroid, a central axis, a central plane perpendicular to the central axis at the centroid and an outer periphery bounded by an outer plane perpendicular to the central axis and wherein the extension is a rim extension that projects to a position between the central plane and the outer plane.

14. The work machine of claim 10, wherein the plate extends beyond the connection of the labyrinth guard and extends with an arcuate geometry.

15. The work machine of claim 10, wherein the plate has an outer edge and wherein a flexible member is attached to the edge.

16. The work machine of claim 10, wherein the roof guard slopes from the frame at an angle in the range of about 30 to 75 degrees.

17. The work machine of claim 8, wherein the cord reinforced rubber flap includes a plurality of pieces.

18. A work machine controlled by an operator upon a grade, comprising:

a frame;

an axle having an end portion having an end, the axle being pivotally connected to the frame;

at least one ground engaging device having an extension having an outer portion, the at least one ground engaging device being connected to the end;

an operator compartment supported by the frame;

an engine operably coupled to the at least one ground engaging device; and an axle protection system, including:

an axle guard assembly having a plate and a labyrinth guard, the axle guard assembly having an outer perimeter and being adjacent to the end portion;

a roof guard fixed to the frame such that refuse is substantially deflected from falling onto the axle and axle guard assembly;

the plate extending substantially vertically from the outer perimeter;

the ground engaging device having a central axis and the roof guard and plate extending in an arc of approximately 120 degrees determined radially from a point along the central axis; and the labyrinth guard projecting generally orthogonally along the plate and spaced apart from the perimeter such that a channel is provided by the configuration of the guard assembly, plate and labyrinth guard and the outer portion is adapted to be received by the channel.

19. A work machine controlled by an operator upon a grade, comprising:

a frame;

an axle having an end portion having an end, the axle being pivotally connected to the frame;

at least one ground engaging device having a central axis and an extension having an outer portion, the at least one ground engaging device being connected to the end;

an operator compartment supported by the frame;

an engine operably coupled to the at least one ground engaging device; and an axle protection system, including:

an axle guard assembly having a plate and a labyrinth guard, the axle guard assembly having an outer perimeter and being adjacent to the end portion;

a roof guard fixed to the frame such that refuse is substantially deflected from falling onto the axle and axle guard assembly;

the plate extending substantially vertically from the outer perimeter;

the labyrinth guard projecting generally orthogonally along the plate and spaced apart from the perimeter such that a channel is provided by the configuration of the guard assembly, plate and labyrinth guard and the outer portion is adapted to be received by the channel; and the channel having a longest dimension in a direction substantially parallel to the central axis of the ground engaging device.

* * * * *